United States Patent [19]

Bussert

[11] Patent Number: 5,010,944

[45] Date of Patent: Apr. 30, 1991

[54] VERTICALLY FOLDABLE WINDOW COVERING AND RETAINING CLIP

[76] Inventor: Althea J. Bussert, P.O. Box 27808, Tempe, Ariz. 85282

[21] Appl. No.: 470,874

[22] Filed: Jan. 26, 1990

Related U.S. Application Data

[63] Continuation-in-part of Ser. No. 231,870, Aug. 12, 1988, which is a continuation-in-part of Ser. No. 37,686, Apr. 13, 1987, Pat. No. 4,836,265.

[51] Int. Cl.[5] ..... A47H 23/00

[52] U.S. Cl. ..... 160/354; 160/84.1; 160/348; 160/368.1

[58] Field of Search ..... 160/354, 368.1, 327, 160/328, 243, 242, DIG. 1, 387, 351, 135, 84.1, 348

[56] References Cited

U.S. PATENT DOCUMENTS

| | | | |
|---|---|---|---|
| 1,429,776 | 8/1922 | Robinson . | |
| 2,246,663 | 6/1941 | Bradshaw | 156/14 |
| 2,299,173 | 1/1942 | Pidgeon | 156/10 |
| 2,514,316 | 7/1950 | Dobrin | 160/102 |
| 2,943,676 | 7/1960 | Grenci | 160/368 |
| 3,283,804 | 11/1966 | Yancey | 160/106 |
| 3,480,069 | 11/1969 | Handwerker | 160/354 |
| 3,913,655 | 10/1975 | Ogino | 160/84 |
| 3,996,083 | 12/1976 | Morgan et al. | 156/92 |
| 4,044,813 | 8/1977 | Emmons | 160/369 |
| 4,068,428 | 1/1978 | Peterson | 52/202 |
| 4,131,150 | 12/1978 | Papadakis | 160/368 |
| 4,221,256 | 8/1980 | Karaki | 160/368 |
| 4,249,589 | 2/1981 | Loeb | 160/368 |
| 4,560,245 | 12/1985 | Sarver | 296/95 |

*Primary Examiner*—Blair M. Johnson

*Attorney, Agent, or Firm*—Cahill, Sutton & Thomas

[57] ABSTRACT

A bendable sheet of material includes a column of apertures and at least one loop interleaved therewith disposed along each opposed vertical side and support structure for suspending the sheet from its upper edge. A pair of clips, secured to the lower edge of the sheet, penetrably cooperate with the columns of apertures to selectively retain the sheet foldable upon itself to a predetermined degree. The pair of clips are adapted to penetrably engage the loops to retain a further fold of the folded part of the sheet to selectively further reduce the area defined by the suspended sheet.

28 Claims, 2 Drawing Sheets

VERTICALLY FOLDABLE WINDOW COVERING AND RETAINING CLIP

CROSS REFERENCE TO RELATED APPLICATIONS

This is a continuation in part application of a copending application entitled "VERTICALLY ADJUSTABLE WINDOW COVERING AND CLIP", Ser. No. 231,870, filed Aug. 12, 1988, which is a continuation in part application of an application entitled "TEMPORARY WINDOW SHADES", filed on Apr. 13, 1987, assigned Ser. No. 037,686, now U.S. Pat. No. 4,836,265, all of which describe inventions by the present inventor.

BACKGROUND OF THE INVENTION

1. Field of the Invention

This invention relates to window coverings and, more particularly, to temporary selectively foldable window shades and clips therefor.

2. Description of the Prior Art

New home owners and renters very often find that they must wait a long time before they are able to install new shades or draperies across their windows. This is especially true in the case of custom made draperies, since the process of measuring, ordering and making the draperies is quite lengthy. Even ready made draperies are usually not purchased immediately as they are somewhat expensive and as the buyer usually shops around before finally selecting permanent draperies.

In order to protect one's privacy, as well as to block out bright sunlight, new occupants frequently resort to temporary measures, such as hanging sheets or pasting newspapers or the like over their windows. Such measures are usually unsatisfactory, as the sheets or newspapers are a nuisance to put up and tend to detract from the internal and external appearance of the house or apartment. In addition, there is no convenient way to raise and lower these types of window coverings. Accordingly, the occupant cannot readily vary the amount of light shining through the windows or selectively have a view of the outdoors.

The closest known attempt to solve the above problems is a temporary paper curtain which has a first strip of stiffener material attached to its top edge and a second strip of stiffener material attached to its bottom edge. The first strip serves as an attachment strip for attaching the curtain to a wall and the second strip serves as a weighting device to ensure that the curtain hangs correctly. In one embodiment of the device, bores are provided through each of the stiffener strips and a plurality of vertically spaced apart holes are provided along one side of the curtain. A pull cord passing through the bores and the aligned holes allow the curtain to be raised and lowered. This apparatus for raising and lowering the curtain is not entirely satisfactory, since the process of boring holes in the stiffener strips and threading the pull cord through the curtain adds to the cost and complexity of the product.

SUMMARY OF THE INVENTION

A sheet of rugged, relatively inexpensive material, such as nylon, polyester, or reinforced paper serves the function of covering a selected part of a window. The upper and lower edges of the covering are preferably folded to form hems and a stiffening rod is inserted into at least the lower hem to provide weight and urge the covering to hang flat. The hem along the top edge may be provided with double-sided adhesive tape, hook and loop type fasteners, or holes for receiving nails, hooks or the like, to secure the top edge to the upper window frame or a wall above the window. A pair of clips extend from the bottom stiffening rod. Each clip includes a support member supporting a planar flange extending in one direction and a hooked flange extending in the other direction. A plurality of slots and loops are formed in longitudinally spaced increments proximate each of the vertical edges of the covering. To raise the covering to a desired height, the covering is folded upwardly to positionally fix the bottom edge of the covering in the folded position by passing the hooked flange of each clip through a respective selected transversely aligned pair of slots in the covering. The folded part of the covering may be folded upwardly again and retained in place by penetrably engaging a transversely aligned pair of loops with the respective planar flanges. By easily disengaging the hooked flanges and planar flanges, the covering will unfold to its depending state and cover the underlying window.

A primary object of the present invention is to provide a vertically foldably adjustable temporary window covering for covering a selected part of a window.

Another object of the present invention is to provide an inexpensive window covering for covering a selectable portion of a window.

Yet another object of the present invention is to provide a clip for retaining at any of a plurality of locations a folded part of a window covering.

Still another object of the present invention is to provide a clip for selectively retaining multiple folds of a depending window covering.

A further object of the present invention is to provide an inexpensive clip attached to the lower edge of a window covering for positionally retaining one or more folds of the window covering to partially uncover the adjacent window.

A yet further object of the present invention is to provide a method for inexpensively covering a window to a selected extent.

A yet further object of the present invention is to provide a removably attached clip for retaining folded portions of a window covering to uncover a selected extent of an adjacent window.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
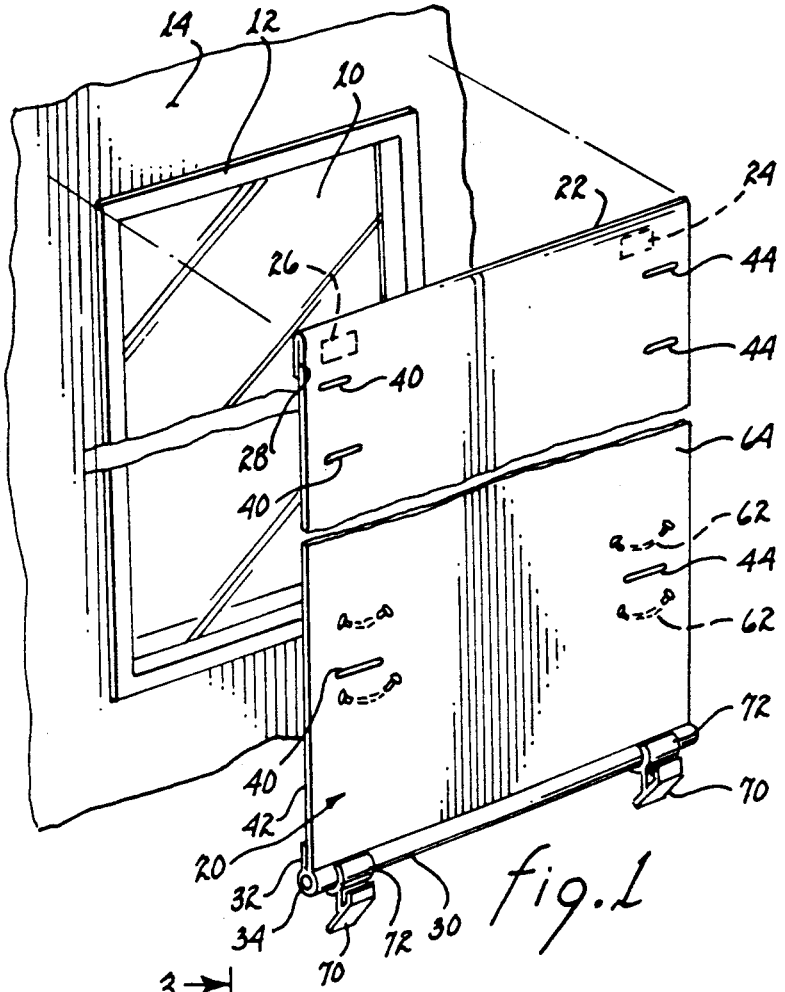
FIG. 1 is an isometric view of a depending window covering locatable adjacent a window.

Referring to FIG. 1, there is shown, in representative form, a window 10 mounted within a frame 12 in wall 14. The window may be any type of window, such as a permanently closed window, a sliding glass window, a casement window, etc. Similarly, frame 12 may be made of any material, such as wood, metal, plastic, etc. Wall 14 may be of conventional construction, stone, stucco, etc.

Coverings for windows are used predominantly to limit the light passing through the window and for reasons of privacy. In conjunction therewith, the type or nature of the window covering is selected primarily for decorative purposes, barring some other overriding concern. At the time of initial occupancy of a dwelling, the windows are usually uncovered pending a decision by the occupant as to type, nature and design of the window coverings. Until permanent window coverings are obtained and installed, the need exists, for reasons stated above, to cover the windows. Preferably, any window covering used for temporary purposes should be capable of being selectively positionable for control of light transmitted through the window and to provide the capability for looking out through the window.

Window covering 20 may be opaque, translucent or may even be of a visually transparent but ultraviolet opaque material. Preferably, it is somewhat tear resistent and readily foldable. Whether window covering 20 is of man-made composite materials, natural fibers or a blend is unimportant for purposes of the invention. For artistic and decorative purposes, the window covering may be colored, patterned or textured.

Structurally, window covering 20 includes an upper edge 22 commensurate in configuration with the upper part of window 10, frame 12 or adjacent wall surface 14. The upper edge may be attached either to the window, to the frame or to the wall surface by two or more patches (24, 26) of double-sided adhesive tape. Other attachment means, such as nails, thumbtacks, hooks, etc. may also be used, if feasible and prudent. Upper edge 22 may include a hem 28, as illustrated, to provide additional rigidity. For long span installations or window coverings which may be exceedingly limp, stiffening means may be added to upper edge 22 to prevent droop of the upper edge or a plurality of attachment points may be used.

The planform of window covering 20 may be rectangular, as illustrated, or of other shape commensurate with the size and configuration of window 10. Alternatively, it may be oversized in situations where minimized light transmissibility is of major concern or where decorative considerations so suggest.

Lower edge 30 of window covering 20 may be hemmed with hem 32, as illustrated, to add stiffness or rigidity to the lower edge. A bar or rod 34 may be inserted within the hem to further stiffen the lower edge. The rod will also add weight, which weight will encourage the window covering to hang straight.

Figure 2:
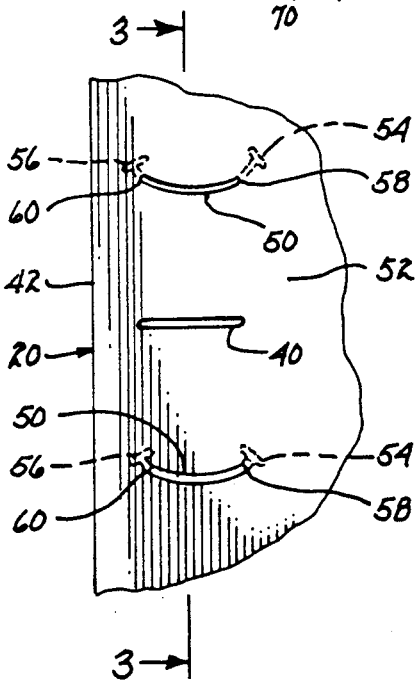
FIG. 2 is a partial view of the window covering and showing slot and loops of the window covering.
Figure 3:
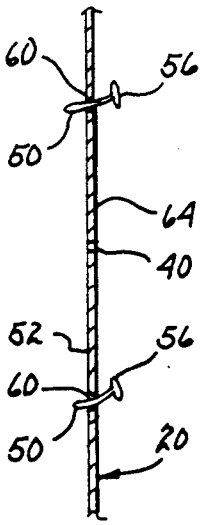
FIG. 3 is a partial view taken along lines 3—3, as shown in FIG. 2.

As shown in FIGS. 1, 2 and 3, a plurality of vertically aligned penetrable means, such as slots 40, are disposed proximate side edge 42 of window covering 20. A plurality of similar slots 44 are vertically aligned along side edge 46. It is intended that slots 40 be transversely generally aligned with slots 44. A plurality of loops 50 extend from rear surface 52 of window covering 20, which loops are in general vertical alignment with slots 40 along edge 42. These loops may be a strand of thread or plastic filament. The latter is particularly useful in that plastic filaments may be obtained which include integrally formed cross members 54,56 at each end. To install loops 50, cross member 54, after being bent into general alignment with the adjacent part of the filament, is penetrably inserted through aperture 58 in window covering 20. Similarly, cross member 56 is bent into general alignment with the adjacent part of the filament and inserted through aperture 60. The cross members, after self alignment transverse to the axis of the filament, will preclude withdrawal of the filament through apertures 58,60. A plurality of similar loops 62 are vertically aligned along edge 46 of window covering 20 and in general vertical alignment with slots 44. As particularly illustrated in FIGS. 2 and 3, the cross members of loops 50 and 62 are disposed adjacent front surface 64 of the window covering and the loop itself is disposed adjacent rear surface 52.

Figure 4:
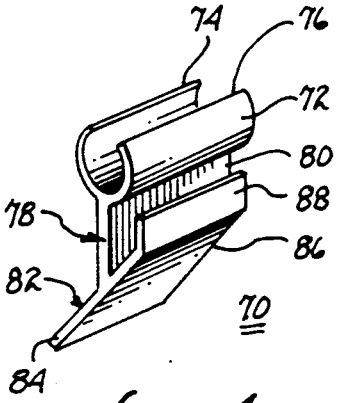
FIG. 4 is an isometric view of a clip usable with the window covering to retain it folded in place.

Referring jointly to FIGS. 1 and 4, clip 70 and its function will be discussed in detail. The clip includes retention means 72 for engaging lower edge 30. In the embodiment illustrated, the retention means is a segment of a split cylindrical sleeve having opposed longitudinal edges 74,76. The diameter of the retention means or sleeve 72 is a function of the diameter of rod 34 and the material of hem 32 extending thereabout, as illustrated in FIG. 1. Preferably, the sleeve is of resilient material to permit the sleeve to grippingly engage the partially encircled rod. Suspension means 78 for selective engagement with the slots and loops includes a support member 80 extending laterally from and in longitudinal alignment with sleeve 72. The support member supports a flange member 82 in a non perpendicular relationship therewith. The flange member includes a planar flange 82 set at an obtuse angle with respect to support member 80 and a hooked flange 86 set at an acute angle with regard to the support member. It may be noted that the planar flange and a substantial part of the hooked flange lie in a common plane and are an extension of one another. The length of each of slots 40,44 is commensurate with the width of flange member 82. Moreover, the width of each of the slots is sufficient to accommodate penetrable engagement by hooked flange 86. Similarly, the length of each of loops 50,62, exposed on side 64 of window covering 20, is commensurate with the width of planar flange 84. Necessarily, these loops must have sufficient slack to permit engagement with planar flange 84 of the respective clips without causing the adjacent portion of the window covering to buckle or have a hump.

Figure 7:
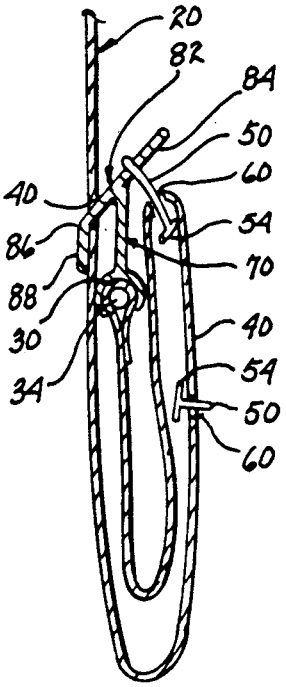
FIG. 7 is a cross sectional view taken along lines 7—7, as shown in FIG. 6.
Figure 5:
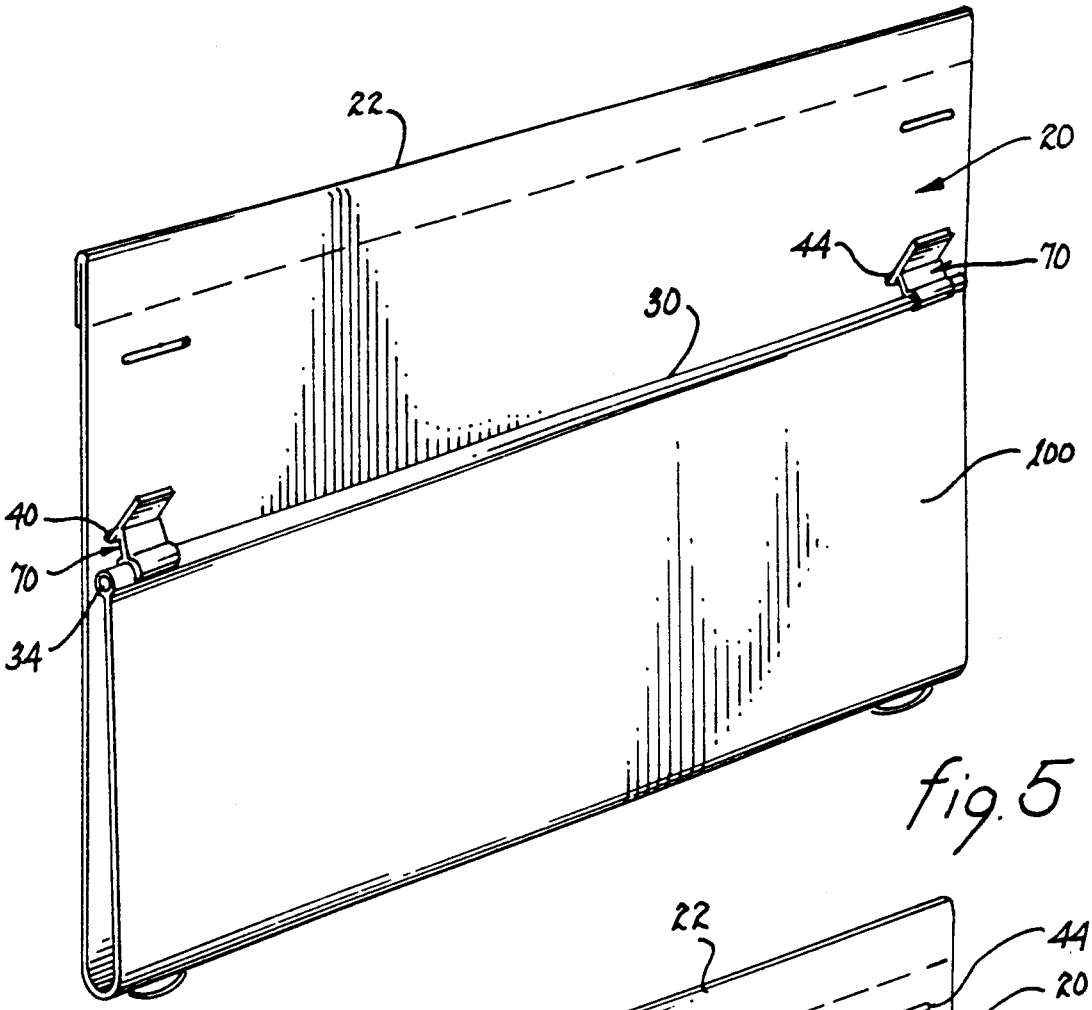
FIG. 5 is an isometric view showing the window covering in a single folded state.
Figure 6:
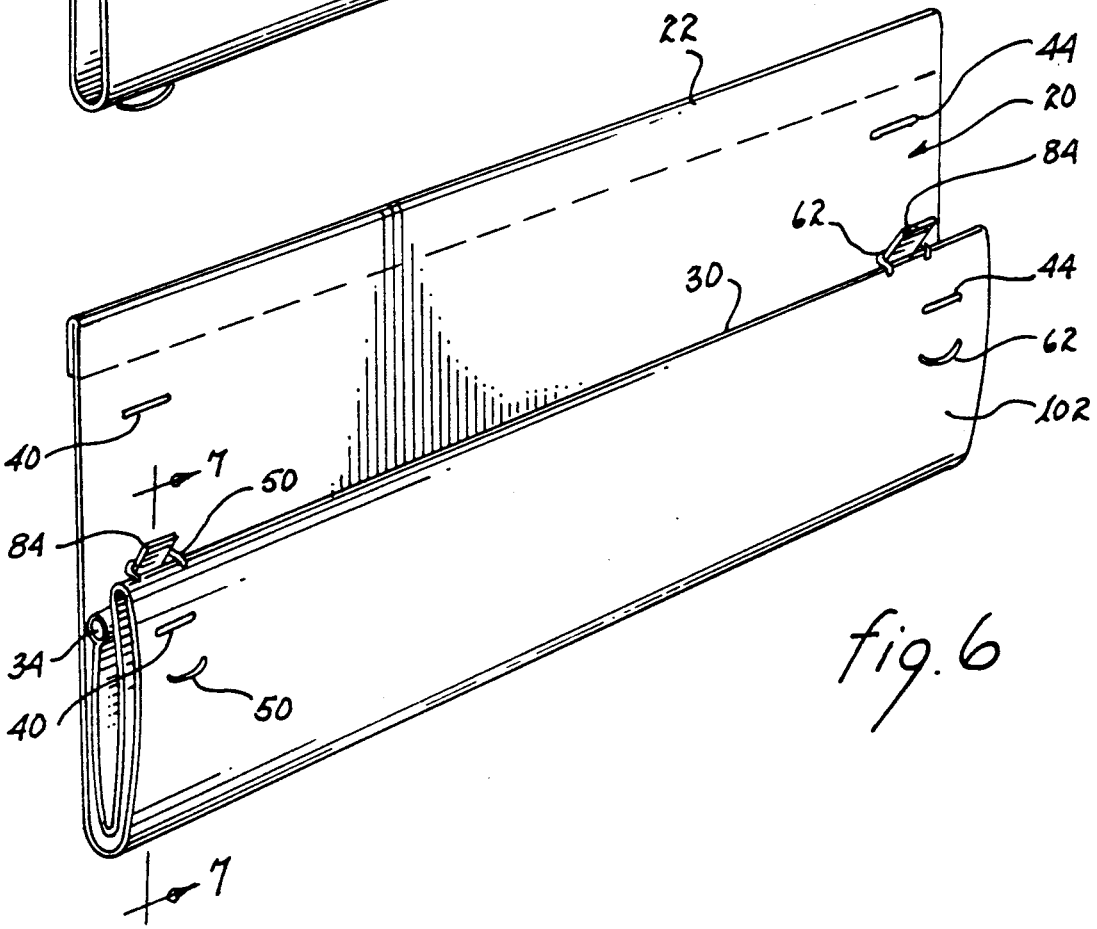
FIG. 6 is an isometric view showing the window covering in a double folded state.

Referring jointly to FIGS. 5, 6 and 7, the operation of the present invention will be described in detail. Window covering 20 depends from the upper part of the frame surrounding window 10, as illustrated in FIG. 1. Being of a length and width greater than the window, the window covering will cover the window. Rod 34, providing both weight and rigidity to bottom edge 30 of the window covering will tend to maintain the window covering generally flat and planar with the window. The additional weight provided by clips 70 may be of assistance in retaining the window covering in place.

To uncover a portion of window 10 for the purpose of letting in light or to see through the window, a lower part of the window covering is folded upwardly upon itself, as represented by first fold portion 100 illustrated in FIG. 5. The first fold portion is retained in place by penetrably engaging hooked flange 86 of flange member 82 with slot 40. A second clip 70 is in similar engagement with transversely aligned slot 44. Because of the angled relationship of hooked flange 86 with respect to support member 80 and the depending relationship of first fold portion 100, the weight of the first fold portion, including rod 34, will tend to urge penetration and maintain hooked engagement between clip 70 and window covering 20. With such urging, possible flapping of the window covering due to an airflow through an opened part of window 10 will generally not result in disengagement of first fold portion 100. Moreover, accidental brushing against the first fold portion will tend not to result in disengagement of clips 70 from the engaged slots.

To obtain yet further exposure of window 10, first fold portion 100 may be folded upon itself, as depicted by second fold portion 102, as shown in FIGS. 6 and 7. In this configuration, planar flanges 84 of the respective clips 70 are engaged by loops 50,62. Because of the angular orientation of the planar flanges, the weight of second fold portion 102 will tend to encourage and maintain penetrable engagement between the loops and the respective planar flanges.

To cover portion of window 10, second fold portion 102 may be slightly lifted by drawing it upwardly and away from the respective clips 70 to bring about disengagement of loops 50,62 with the corresponding planar flanges of clips 70. Thereafter, second fold portion 102 may be released to permit it to drop. Similarly, first fold portion 100 is readily released by repositioning lower edge 30 upwardly and away from window 10 to disengage hooked flanges 86 of clips 70 with corresponding slots 40, 44. The lower edge may then be allowed to drop whereafter covering 20 will assume the position depicted in FIG. 1 to cover window 10.

A plurality of vertically spaced slots 40 and 44 in covering 20 permit altering the height of first fold portion 100 from a minimal height to approximately half of the height of window covering 20. A plurality of vertically spaced loops 50 and 62 are incorporated in window covering 20 to permit variations in height of second fold portion 102. Accordingly, the initial exposure of window 10 by first fold portion 100 may be incrementally increased by second fold portion 10 and depending upon which ones of transversely aligned loops 50,62 are brought into engagement with respective clips 70. With the configuration of loops illustrated in the figures, approximately ¾ of window 10 can be uncovered upon a maximum height of each of the first fold portion and the second fold portion.

Because the cross section of clip 70 is uniform throughout the longitudinal length of the clip, it is well adapted for manufacture by conventional extrusion techniques. Accordingly, an extended length of clip 70 can be readily manufactured of suitable plastic material at a very nominal cost. Thereafter, the length can be cut to any length segments suitable for the purposes described above. By forming clip 70 of material having a certain degree of resiliency and flexibility, any given diameter of retention means 72 can accommodate a range of different diametrically sized rods 34 and encircling hem 32. It is to be noted that the retention means can be otherwise configured to accommodate various means for attaching clip 70 to lower edge 30, whether the lower edge is flat, rectangular, circular, etc. Moreover, other fastening means may be employed to secure retention means 72 to the lower edge of the covering.

From the above description and the accompanying illustrations, it will be apparent that window covering 20 is relatively simple in structure and yet clip 70 is sufficiently sophisticated in design and configuration to permit great ease in folding over and retaining one or more folds of the window covering. Even though window covering 20 may be of sufficiently inexpensive material to be used as a temporary discardable covering, it is capable of providing all of the advantages of more conventional window coverings with respect to light control, privacy, selected exposure of the window and decorative value.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. Apparatus for temporarily covering a window to a selected degree of exposure, said apparatus comprising in combination:

I. a window covering comprising:
- (a) material foldable upon itself to expose the window commensurate with the number and height of folds;
- (b) at least a column of slots extending upwardly from a lower edge of said covering;
- (c) at least one loop in vertical alignment with said column of slots; and
- (d) means for vertically dependingly supporting said covering across a window;

II. a clip comprising:
- (a) retention means for retaining the lower edge of said covering;
- (b) a hooked flange for engaging one of said slots, said hooked flange having a width commensurate with the width of said slots for penetrably engaging one of said slots upon folding of a lower part of said covering adjacent an upper part of said covering;
- (c) a flange for engaging one of said loops, said flange having a width commensurate with the width of said loops for penetrably engaging one of said loops upon folding of a lower part of said folded covering adjacent an upper part of said folded covering; and
- (d) means for supporting said hooked flange and said flange upon said retention means;

whereby, said clip can retain said covering folded over once or twice to expose a part of the covered window.

2. The apparatus as set forth in claim 1 wherein said hooked flange extends at an acute angle from said supporting means and said flange extends at an obtuse angle from said supporting means.

3. The apparatus as set forth in claim 1 wherein the said covering includes a rod disposed along the lower edge and wherein said retention means includes means for engaging the rod.

4. The apparatus as set forth in claim 3 wherein said engaging means includes a split sleeve for partially encircling said rod.

5. The apparatus as set forth in claim 4 wherein said split sleeve is of resilient material to permit gripping of said rod by said split sleeve.

6. The apparatus as set forth in claim 4 wherein said supporting means comprises a planar section extending radially from said split sleeve to a terminal edge.

7. The apparatus as set forth in claim 6 wherein said hooked flange and said flange are disposed at said terminal edge of said planar section.

8. The apparatus as set forth in claim 7 wherein said hooked flange extends at an acute angle from said planar section and said flange extends at a complementary obtuse angle from said planar section.

9. An adjustable temporary and discardable window covering for providing selected exposure through a window, said covering comprising in combination:

(a) a sheet of material for limiting the exposure of a window;

(b) means for attaching said sheet in vertically depending relationship adjacent the window;

(c) at least one first penetrable means disposed in one vertical section of said sheet;

(d) at least one first loop means disposed in the one vertical section of said sheet;

(e) at least one second penetrable means disposed in an other vertical section of said sheet;

(f) at least one second loop means disposed in the other vertical section of said sheet; and (g) suspension means associated with the lower part of said sheet for selectively retainingly engaging said first and second penetrable means in said one and other vertical sections of said sheet to removably retain said sheet at least partially folded upwardly upon itself upon engagement of said suspension means with at least one of said first and second penetrable means, said suspension means comprising means for retaining a part of said sheet, means for penetrably engaging a selected one of said first and second penetrable means and further means for penetrably engaging said first and second loop means upon further folding of said sheet, said engaging means and said further engaging means extending in opposed directions.

10. The apparatus as set forth in claim 9 wherein said engaging means and said further engaging means include means for maintaining penetrable engagement with said first and second penetrable means engaged by said engaging means and with said first and second loop means engaged by said further engaging means in response to the weight of the folded and further folded parts, respectively, of said sheet.

11. The apparatus as set forth in claim 9 wherein said sheet includes a bottom edge and wherein said suspension means is secured to said bottom edge.

12. The apparatus as set forth in claim 9 including a column of each of said first and second penetrable means and a column of said first and second loop means.

13. The apparatus as set forth in claim 12 wherein said columns of first and second loop means are interleaved with said columns of first and second penetrable means, respectively.

14. Apparatus for selectively varying the vertical length of a horizontally foldable covering, said apparatus comprising in combination:

(a) a horizontally foldable sheet of material having an upper and a lower part;

(b) means for attaching the upper part of said sheet to a supporting structure;

(c) suspension means associated with the lower part of said sheet for suspending a folded part of said sheet in a vertically depending vertically overlapping relationship with a remaining part of said sheet;

(d) at least one first means for engaging said suspension means to assist in suspending the folded part of said sheet, said first means being disposed in one vertical section of said sheet;

(e) at least one second means for engaging said suspension means to assist in suspending the folded part of said sheet, said second means being disposed in an other vertical section of said sheet;

(f) at least one third means in vertical alignment with said first means for engaging said suspension means to assist in suspending a further folded part of said sheet;

(g) at least one fourth means invertical alignment with said second means for engaging said suspension means to assist in suspending the further folded part of said sheet; and (h) said third and fourth means cooperating for maintaining said further folded part in a further vertically overlapping relationship with said folded part.

15. The apparatus as set forth in claim 14 wherein each of said first and second means comprises first and second means for penetrably receiving a part of said suspension means.

16. The apparatus as set forth in claim 14 wherein each of said third and fourth means comprises third and fourth means for penetrably receiving a part of said suspension means.

17. The apparatus as set forth in claim 16 wherein each of said first and second means comprises first and second means for penetrably receiving a part of said suspension means.

18. The apparatus as set forth in claim 14 wherein said suspension means includes first suspension means associated with said first and third means and second suspension means associated with said second and fourth means.

19. The apparatus as set forth in claim 18 wherein each of said first and second means comprises first and second means for penetrably receiving a part of said suspension means.

20. The apparatus as set forth in claim 19 wherein said first means comprises a first slot in said sheet and said second means comprises a second slot in said sheet.

21. Apparatus for selectively varying the vertical length of a horizontally foldable covering, said apparatus comprising in combination:

(a) a horizontally foldable sheet of material having an upper and a lower part;

(b) means for attaching the upper part of said sheet to a supporting structure;

(c) suspension means, including first and second suspension means, associated with the lower part of said sheet for suspending a folded part of said sheet from a remaining part of said sheet;

(d) at least one first means comprising a first slot in said sheet for penetrably receiving said first suspension means to assist in suspending the folded part of said sheet, said first means being disposed in one vertical section of said sheet;

(e) at least one second means comprising a second slot in said sheet for penetrably receiving said second suspension means to assist in suspending the folded part of said sheet, said second means being disposed in an other vertical section of said sheet;

(f) at least one third means in vertical alignment with said first means for engaging said first suspension means to assist in suspending a further folded part of said sheet;

(g) at least one fourth means in vertical alignment with said second means for engaging said second suspension means to assist in suspending the further folded part of said sheet;

(h) said first suspension means including a first folded flange for engaging said first slot and said second suspension means including a second folded flange for engaging said second slot.

22. The apparatus as set forth in claim 19 wherein said third means comprises a first loop extending from said sheet and said fourth means comprises a second loop extending from said sheet.

23. The apparatus as set forth in claim 22 wherein said first suspension means includes a first folded flange for engaging said first slot, said second suspension means includes a second folded flange for engaging said second slot, said third means comprises a first loop extending from said sheet, said fourth means comprises a second loop extending from said sheet, said first suspension means includes a third flange for engaging said first loop and said second suspension means includes a fourth flange for engaging said second loop.

24. The apparatus as set forth in claim 23 wherein said first means comprises a first slot in said sheet and said second means comprises a second slot in said sheet.

25. The apparatus as set forth in claim 24 wherein said first suspension means includes a first folded flange for engaging said first slot and wherein said second suspension means includes a second folded flange for engaging said second slot.

26. The apparatus as set forth in claim 25 wherein said first means includes a plurality of vertically aligned ones of said first slots and wherein said second means includes a plurality of vertically aligned ones of said second slots, whereby different heights of the folded part can be accommodated.

27. The apparatus as set forth in claim 25 wherein said third means includes a plurality of vertically aligned ones of said first loops and wherein said fourth means includes a plurality of vertically aligned ones of said second loops, whereby different heights of the further folded part can be accommodated.

28. The apparatus as set forth in claim 26 wherein said third means includes a plurality of vertically aligned ones of said first loops and wherein said fourth means includes a plurality of vertically aligned ones of said second loops, whereby different heights of the further folded part can be accommodated.

* * * * *